US007691338B2

(12) United States Patent
Alvin et al.

(10) Patent No.: US 7,691,338 B2
(45) Date of Patent: Apr. 6, 2010

(54) TWO STAGE CATALYTIC COMBUSTOR

(75) Inventors: Mary Anne Alvin, Pittsburgh, PA (US); Dennis Bachovchin, Delmont, PA (US); Eugene E. Smeltzer, Export, PA (US); Thomas E. Lippert, Murraysville, PA (US); Gerald J. Bruck, Murraysville, PA (US)

(73) Assignee: Siemens Energy, Inc., Orlando, FL (US)

( * ) Notice: Subject to any disclaimer, the term of this patent is extended or adjusted under 35 U.S.C. 154(b) by 964 days.

(21) Appl. No.: 10/797,455

(22) Filed: Mar. 10, 2004

(65) Prior Publication Data

US 2005/0201906 A1 Sep. 15, 2005

(51) Int. Cl.
*B01D 50/00* (2006.01)
*B01D 53/34* (2006.01)
*F01N 3/00* (2006.01)

(52) U.S. Cl. ..... 422/168; 422/177; 422/188; 422/189; 422/190

(58) Field of Classification Search ..... 422/177, 422/180, 168, 188–190
See application file for complete search history.

(56) References Cited

U.S. PATENT DOCUMENTS 3,928,961 A 12/1975 Pfefferle
3,953,176 A * 4/1976 Santala et al. ..... 422/171
4,270,896 A * 6/1981 Polinski et al. ..... 431/328
5,080,577 A * 1/1992 Bell et al. ..... 431/7
5,110,561 A * 5/1992 Hitachi et al. ..... 422/180
5,154,970 A 10/1992 Kaplan et al.
5,173,267 A * 12/1992 Maus et al. ..... 422/179
5,183,401 A * 2/1993 Dalla Betta et al. ..... 431/7
5,202,303 A 4/1993 Retallick et al.
5,207,053 A * 5/1993 Spadaccini et al. ..... 60/780
5,228,847 A * 7/1993 Lywood et al. ..... 431/7
5,258,349 A 11/1993 Dalla Betta et al.
5,328,359 A 7/1994 Retallick
5,399,324 A 3/1995 Subramanian et al.
5,439,651 A * 8/1995 Kato ..... 422/179
5,453,003 A 9/1995 Pfefferle (Continued)

OTHER PUBLICATIONS

Butler, Bret; Bartletto, Roberta; Bradshaw, Larry; Cohen, Jack; Andrews, Patricia; Putnam, Ted; Mangan, Richard, Fire Behavior Associated with the 1994 South Canyon Fire on Storm King Mountain, Colorado, Sep. 1998, United States Department of Agriculture, RMRS-RP-9, p. 68.*

*Primary Examiner*—Walter D Griffin
*Assistant Examiner*—Natasha Young

(57) ABSTRACT

A catalytic combustor (14) includes a first catalytic stage (30), a second catalytic stage (40), and an oxidation completion stage (49). The first catalytic stage receives an oxidizer (e.g., 20) and a fuel (26) and discharges a partially oxidized fuel/oxidizer mixture (36). The second catalytic stage receives the partially oxidized fuel/oxidizer mixture and further oxidizes the mixture. The second catalytic stage may include a passageway (47) for conducting a bypass portion (46) of the mixture past a catalyst (e.g., 41) disposed therein. The second catalytic stage may have an outlet temperature elevated sufficiently to complete oxidation of the mixture without using a separate ignition source. The oxidation completion stage is disposed downstream of the second catalytic stage and may recombine the bypass portion with a catalyst exposed portion (48) of the mixture and complete oxidation of the mixture. The second catalytic stage may also include a reticulated foam support (50), a honeycomb support, a tube support or a plate support.

14 Claims, 4 Drawing Sheets

U.S. PATENT DOCUMENTS 5,538,697 A * 7/1996 Abe et al. ..... 422/171
5,618,505 A 4/1997 Subramanian et al.
5,634,784 A 6/1997 Pfefferle et al.
5,645,803 A * 7/1997 Steenackers et al. ..... 422/177
5,800,789 A * 9/1998 Yoshizaki ..... 422/174
5,820,832 A * 10/1998 Huttenhofer et al. ..... 422/171
6,040,266 A * 3/2000 Fay et al. ..... 502/439
6,048,194 A 4/2000 Pfefferle et al.
6,103,149 A 8/2000 Stankiewicz
6,155,819 A 12/2000 Etemad et al.
6,217,832 B1 * 4/2001 Betta et al. ..... 422/179
6,358,040 B1 * 3/2002 Pfefferle et al. ..... 431/7
6,365,283 B1 * 4/2002 Bruck ..... 428/593
6,394,791 B2 5/2002 Smith et al.
6,475,446 B1 * 11/2002 Horiike et al. ..... 422/180
6,531,425 B2 3/2003 Golden
6,667,017 B2 * 12/2003 Murrell et al. ..... 423/210
2002/0076372 A1 * 6/2002 Leloup et al. ..... 422/222
2002/0139122 A1 10/2002 Alvin et al.
2003/0072693 A1 * 4/2003 Karrs et al. ..... 422/176

* cited by examiner

TWO STAGE CATALYTIC COMBUSTOR

STATEMENT OF GOVERNMENT INTEREST

The Government of the United States of America has certain rights in this invention pursuant to contract no. NAS3-00006 awarded by the National Aeronautics and Space Administration (NASA).

FIELD OF THE INVENTION

This invention relates generally to the field of power generation, and more particularly, to catalytic combustors.

BACKGROUND OF THE INVENTION

Catalytic combustion systems are well known in gas turbine applications to reduce the creation of pollutants, such as NOx, in the combustion process. One catalytic combustion technique known as the rich catalytic, lean burn (RCL™) combustion process includes mixing fuel with a first portion of compressed air to form a rich fuel mixture. The rich fuel mixture is passed over a catalytic surface and partially oxidized, or combusted, by catalytic action. Activation of the catalytic surface is achieved when the temperature of the rich fuel mixture is elevated to a temperature at which the catalytic surface becomes active. Typically, compression raises the temperature of the air mixed with the fuel to form a rich fuel mixture having a temperature sufficiently high to activate the catalytic surface. After passing over the catalytic surface, the resulting partially oxidized rich fuel mixture is then mixed with a second portion of compressed air in a downstream combustion zone to produce a heated lean combustion mixture for completing the combustion process, typically by igniting and stabilizing the lean combustion mixture using a high temperature, NOx producing pilot flame. The heated combustion mixture form the first stage may reduce a size of a pilot flame required to stabilize combustion, but completion of combustion using a catalyst may eliminate the need to use a pilot flame. Catalytic combustion reactions may produce less NOx and other pollutants, such as carbon monoxide and hydrocarbons, than pollutants produced by homogenous combustion, even in the absence of a pilot flame.

In the past, catalysts have been used to partially combust rich fuel mixtures at temperatures up to about 800 degrees Centigrade (C.), but higher combustion temperatures have proven to be destructive to the catalysts and catalyst supports. Catalysts capable of operating at higher combustion temperatures of over 1000 degrees C. have been proposed, but such catalysts may have a catalytic activation temperature much higher than a compressed air temperature achievable by compression alone.

BRIEF DESCRIPTION OF THE DRAWINGS

The invention will be more apparent from the following description in view of the drawings that show.

DETAILED DESCRIPTION OF THE INVENTION

The inventors have developed an innovative two-stage catalytic combustor for partially catalytically combusting a fuel/air mixture in a first-stage at a relatively lower temperature, and then catalytically completing combustion of the partially oxidized fuel/air mixture in a second-stage at a relatively higher temperature. Advantageously, the first-stage partial combustion elevates the temperature of the partially oxidized fuel/air mixture entering the second-stage to a temperature sufficient for activating a catalyst in the second-stage to completely combust the partially oxidized fuel/air mixture. Accordingly, by providing complete catalytic combustion, pollutant formation may be reduced compared to other conventional catalytic combustion techniques.

Figure 1:
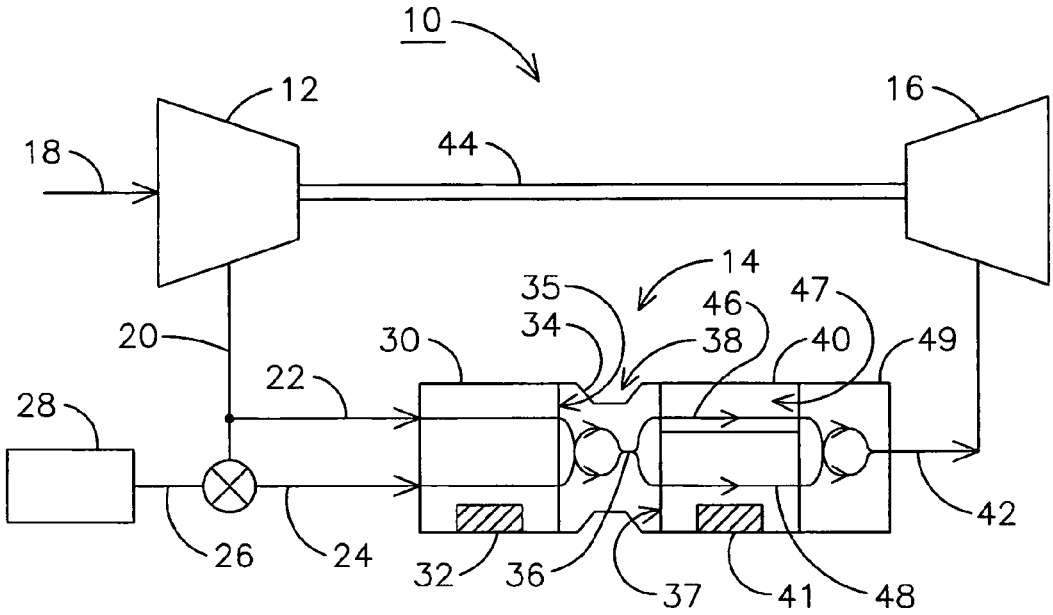
FIG. 1 is a functional diagram of a gas turbine 10 including a two-stage catalytic combustor 14.

FIG. 1 is a functional diagram of a gas turbine 10 including a two-stage catalytic combustor 14. The gas turbine 10 includes a compressor 12 for receiving ambient air 18 and producing compressed air 20. The compressed air 20 may be separated into a premix fluid flow 24 and a cooling fluid flow 22, respectively, for introduction into a first catalytic stage 30 of the catalytic combustor 14. The premix fluid flow 24 may be mixed with a flow of a combustible fuel 26, such as natural gas, syngas, or fuel oil, for example, provided by a fuel source 28, prior to introduction into the catalytic combustor 14. The cooling fluid flow 22 may be introduced directly into the catalytic combustor 14 without mixing with the combustible fuel 26. Optionally, the cooling fluid flow 22 may be mixed with a flow of combustible fuel 26 before being directed into the catalytic combustor 14.

In the first catalytic stage 30, the premixed fluid flow 24 may be partially oxidized, by exposure to a first-stage catalytic structure 32. After exiting the first-stage 30, the premixed fluid flow 24 and the cooling fluid flow 22 may be mixed in the transition stage 34 to create a partially oxidized fuel/oxidizer mixture 36. In an aspect of the invention, the transition stage 34 may be configured to limit further combustion of the partially oxidized fuel oxidizer mixture 36. For example, by eliminating recirculation regions and potential flame attachment points in the transition stage 34, further combustion of the partially oxidized fuel oxidizer mixture 36 may be restricted. In another aspect, the transition stage 34 may include a narrowed flow area region 38 generating a venturi effect for preventing flashback into the transition stage 34 and protecting the first catalytic stage 30 from the heat generated by a downstream second catalytic stage 40 of the catalytic combustor 14. The narrowed region 38 may be disposed between an inlet end 35 receiving the partially oxidized fuel/oxidizer mixture 36 and an outlet end 37 discharging the partially oxidized fuel/oxidizer mixture 36. In yet another aspect, the transition stage 34 may be relatively short compared to the first and second catalytic stages 30, 40.

The partially oxidized fuel/oxidizer mixture 36 flows from the transition stage 34 into the second catalytic stage 40 of the catalytic combustor 14. In the second catalytic stage 40, the partially oxidized fuel/oxidizer mixture 36 may be further combusted by exposure to a second-stage catalytic structure 41. In an aspect of the invention, the partially oxidized fuel/oxidizer mixture 36 may be split into a catalyst-exposed portion 48 and a bypass portion 46. The catalyst-exposed portion 48 may be exposed to the second-stage catalytic structure 41, while a bypass portion 46 may be directed around the catalytic structure 41 via a bypass passageway 47. The portions 46, 48 may be recombined in a downstream combustion completion stage 49. Advantageously, an outlet temperature of the catalyst exposed portion 48 exiting from the second catalytic stage 40 may be elevated sufficiently to complete oxidization in the downstream combustion completion stage 49 without using a separate ignition source, such as a pilot, to produce a hot combustion gas 42. The hot combustion gas 42 is then delivered to a turbine 16 where it is expanded to develop shaft power. Typically, the turbine 16 and compressor 12 are connected to a common shaft 44. The aforementioned components of the gas turbine 10 are fairly typical of those found in the prior art, and other known variations of these components and related components may be used in other embodiments of the present invention.

The first catalytic stage 30 may include conventional catalysts and catalyst supports such as are typically used in backside-cooled catalytic combustors. For example, the first catalytic stage 30 may include catalyst-coated honeycomb structures, tubes, rods, or plates disposed within the catalytic combustor 14 and oriented to allow a fluid to flow unimpeded therethrough. However, because of the elevated temperatures associated with combustion completion of the partially oxidized fuel/oxidizer mixture 36, different catalysts and catalyst support structures capable of withstanding such elevated temperatures need to be used in the second catalytic stage 40. Although the partially oxidized fuel/oxidizer mixture 36 may have a temperature of 500-550 degrees C. when entering the second catalytic stage 40, the catalyst exposed portion 48 exiting the second catalytic stage 40 may be elevated to a temperature of between 1100 to 1400 degrees C. Accordingly, catalyst support structures formed from materials capable of withstanding such elevated temperatures are required in the second catalytic stage 40. For example, oxide-based ceramic structures composed of alumina, titania, zirconia, and/or cordierites (marketed, for example, Selee Corporation, Applied Ceramics, Inc. and CeraMem Corporation), or non oxide-based ceramic structures composed of silicon carbide or silicon nitride (marketed, for example, by UltraMet, Inc. and Specific Surface Corporation), may be used for the catalyst support. Oxide-based ceramics may be enhanced with a washcoat containing catalytic materials such as a perovskite, zeolite, hexaaluminate, and the like, or combinations thereof. Non-oxide based ceramics may be initially coated with an oxidation-resistant stabilized alumina coating and then enhanced with a washcoat containing catalyst composition such as perovskite, zeolite, hexaaluminate, and the like, or combinations thereof. In another aspect, the catalyst support may be fabricated from advanced alloys, such as Incoloy™ alloy MA956 and Fecralloy (iron-chromium-aluminum-based alloys), Kanthal series metals (molybdenum disilicide alloys, such as Kanthal Super 1800, 1900 and the like), or intermetallics such as iron aluminide. A catalytic material may be applied to the metallic structure, or a thermal barrier coating (TBC) may be applied to the structure prior to application of catalytic material. Regardless of the type of material used for making the support, the catalyst support may be fabricated in a desired forms such as honeycomb structures, tubes, plates, tower packings, such as Rashig rings, and/or packed particles, and the like.

In another aspect, the second catalytic stage 40 may include a reticulated foam catalyst support having a network of pores for allowing passage of a fluid therethrough and capable of withstanding the elevated temperatures associated with combustion completion. For example, a ceramic based reticulated foam catalyst support, such as a silicon carbide reticulated foam catalyst support marketed by Ultramet, Inc., may be used. The reticulated foam catalyst support may be enhanced with a washcoat to increase an effective surface area of the support. A catalyst such as a perovskite, zeolite, and/or hexaaluminate, and the like may be incorporated in the washcoat, or subsequently applied over the washcoat. The reticulated foam catalyst support may be sized to completely fill a cross-section of the second catalytic stage 40 of the combustor 14 so that the partially oxidized fuel/oxidizer mixture entering the second-stage passes though the catalyst support. For example, in a cylindrical combustor, the catalyst support may comprise a cylindrical section having an outside diameter substantially equal to an inside diameter of the combustor.

Compared to a conventional plate or tube supported catalyst, such as used for partial catalytic combustion in an RCL™ process, it has been determined that second-stage catalytic combustion may require a relatively higher surface contact area between the catalyst and a fuel/oxidizer mixture to provide complete combustion of the mixture. Higher surface contact area may require a more flow-restrictive catalyst support (for example, smaller pores in a ceramic reticulated foam support, or smaller cross-sectional area passageways in a honeycomb support) than would typically be used in a comparably sized conventional catalytic combustor.

Unfortunately, catalyst supports having a smaller pore size or smaller cross-sectional area passageways may lead to an increased pressure drop across the support, compared to larger sized pores or passageways. One way of reducing the pressure drop across the catalyst support is to ensure, in the case of a reticulated foam support, that the porosity of the reticulated foam support is sufficiently open (or, in the case of other structures, to ensure that the cross-sectional area of the passageways are sufficiently sized) to minimize a pressure drop across the catalyst support, while retaining sufficient catalytic surface area throughout the structure to achieve a desired level of catalytic combustion. For example, in the case of a reticulated foam support, a pore size grade, or number of pores per lineal inch (ppi), of 3 to 5 ppi may be used for catalytic combustion without inducing a prohibitively large pressure differential across the support.

Figure 2A:
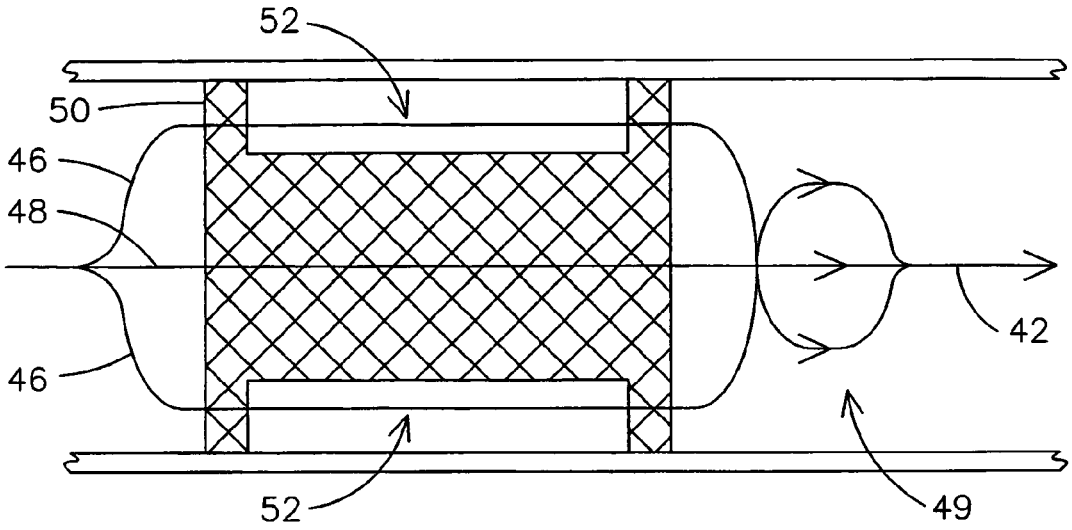
FIG. 2A shows a longitudinal cross-sectional view of a reticulated foam catalyst disposed within a combustor.

Innovatively, the inventors have overcome the problem of increased pressure drop associated with an increased catalyst density by providing a passageway for bypassing a portion of the partially oxidized fuel/oxidizer mixture past the catalyst support. For example, a foam catalyst support presenting a cross-sectional area less than a cross-sectional area of a pressure boundary of the second catalytic stage 40 may be used to define a passageway allowing a portion of the fuel/oxidizer mixture to bypass the foam support. FIG. 2A shows a longitudinal cross-sectional view of a reticulated foam catalyst support 50 disposed within the second catalytic stage 40 of the combustor 14 of FIG. 1. A bypass portion 46 of the partially oxidized fuel/oxidizer mixture may be bypassed through a passageway 47, such as an annular passageway 52, around the catalyst support 50 while a catalyst-exposed portion 48 of the partially oxidized gas may be directed through pores in the catalyst support 50 and catalytically combusted. At a downstream end of the catalyst support 50, the catalyst-exposed portion 48, directed through the catalyst support 50 and having an elevated temperature as a result of catalytic combustion, mixes with and ignites the bypass portion 46 downstream of the catalyst support 50 in a downstream combustion stage 49 to produce a completely combusted hot combustion gas 42. By providing such a passageway for bypassing the bypass portion 46 around the catalyst support 50, an overall pressure drop across the catalyst support 50 may be reduced compared to a catalyst support filling a cross-sectional area of the second catalytic stage 40. For example, the passageway(s) may be sized to allow 25% to 80% of the partially oxidized fuel/oxidizer mixture 36 to bypass the catalyst support 50 in the bypass portion 46. Advantageously, by providing such passageways, a more flow-restrictive, or higher ppi, reticulated foam catalyst support having a correspondingly increased catalytic surface area (compared to a less flow-restrictive foam catalyst support without passageways) may be used to increase catalytic activity without resulting in an increased overall pressure drop across the catalyst support 50. For example, a reticulated foam support having about 45 ppi may be used with sufficiently sized passageways so that an overall pressure drop across the catalyst support 50 does not exceed a predetermined pressure drop.

Figure 2B:
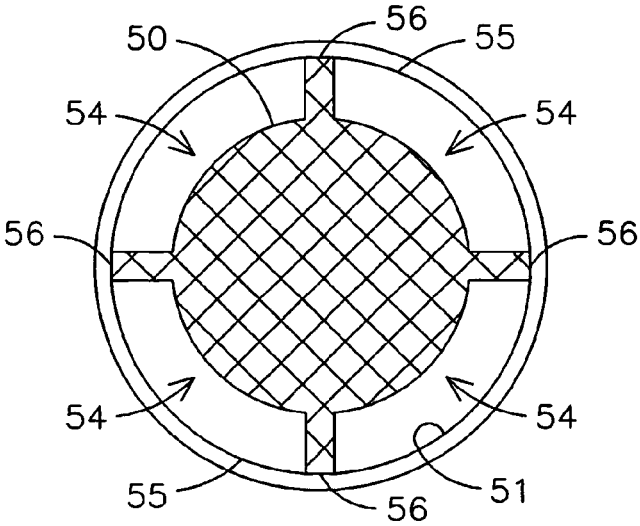
FIG. 2B shows a cross-sectional view of an exemplary embodiment of the catalyst of FIG. 2A.
Figure 2C:
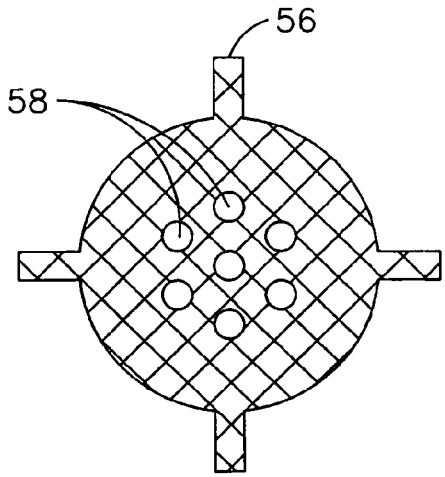
FIG. 2C shows a cross-sectional view of another exemplary embodiment of the catalyst of FIG. 2A.
Figure 3A:
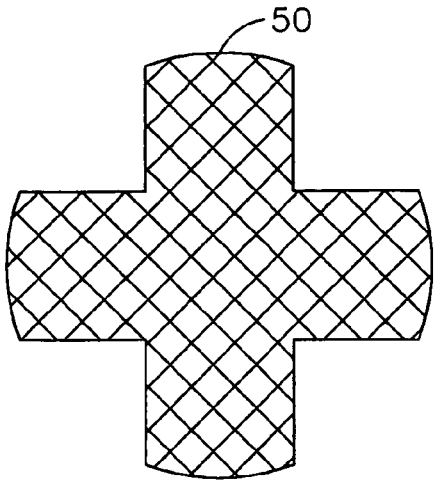
FIG. 3A shows a cross-sectional view of an exemplary embodiment of a reticulated foam catalyst.
Figure 3B:
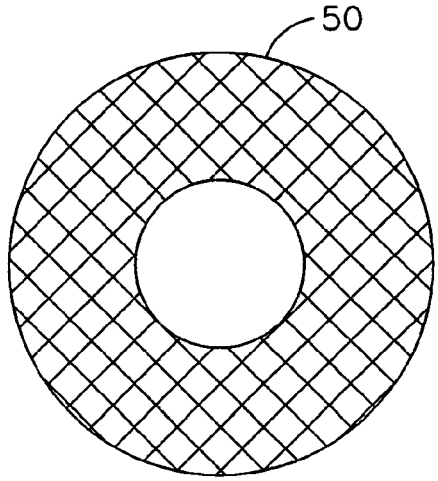
FIG. 3B shows a cross-sectional view of an exemplary embodiment of a reticulated foam catalyst.
Figure 3C:
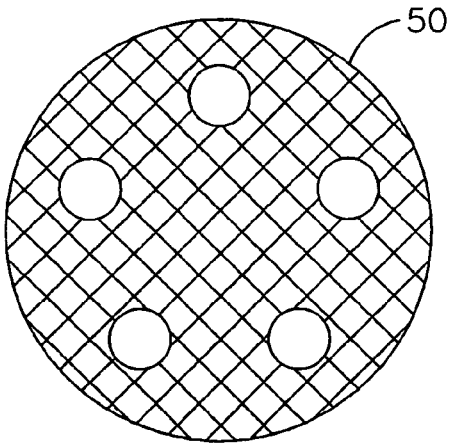
FIG. 3C shows a cross-sectional view of an exemplary embodiment of a reticulated foam catalyst.

FIG. 2B shows a cross-sectional view of an exemplary embodiment of the catalyst support of FIG. 2A. As shown in FIG. 2B, portions 54 of a perimeter of the catalyst support 50 may be removed so that when the catalyst support 50 is installed in the combustor, the portions 54 form annular passageways 52 between the catalyst support 50 and a pressure boundary wall 51 for bypassing the first portion 46 around the catalyst support 50. The catalyst support 50 may include standoffs 56 to space the catalyst support 50 away from the pressure boundary wall 51. In another aspect depicted in FIG. 2C, additional passageways may be provided, such as spaced apart tubular passageways 58, extending longitudinally through the catalyst support 50. It should be understood that the passageways 58 may be configured in any desired geometric configuration and be placed in any portion of the catalyst support 50, with or without an annular passageway 52, to bypass a desired first portion 46 of the partially oxidized fuel/oxidizer mixture 36 past the catalyst support 50. In another aspect, the catalyst support 50 may be configured to have a cruciform cross-section as shown in FIG. 3A. In yet another aspect, the catalyst support 50 may be configured to have a donut-shaped cross-section as shown in FIG. 3B. Such cross-sections may incorporate additional passageways formed longitudinally through the catalyst support 50. In still another aspect, the catalyst support 50 may be configured to have a multitude of circumferentially spaced passageways extending longitudinally through the support 50 as shown in FIG. 3C. These cross-sections may also be formed in other catalyst support structures such as honeycomb structures, plate structures, tube structures, and granular structures (such as by using packed particle beds or tower packing beds with tubes to define passageways).

Figure 4:
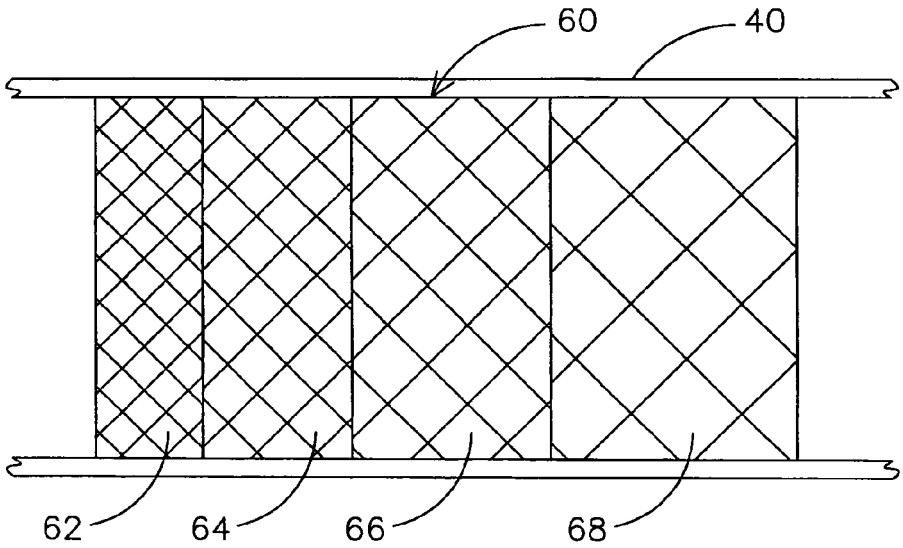
FIG. 4 shows a longitudinal cross-sectional view of an exemplary embodiment of a reticulated foam catalyst having different regions.

FIG. 4 shows a reticulated foam catalyst structure 60 having different regions 62, 64, 66, 68 spaced along a longitudinal axis of the second catalytic stage 40. Each region 62, 64, 66, 68 may be configured to have a desired characteristic, such as a catalyst composition, pore size, porosity, or axial width different from another region. For example, each region 64, 66, 68 may include a catalyst selected to promote further oxidation of a fuel/oxidizer mixture flowing therethrough based on reaction products generated by an adjacent upstream region 62, 64, 66. In an aspect of the invention, each region 62, 64, 66, 68 may be a separate catalytic element. In yet another aspect each region 62, 64, 66, 68 may include passageways for bypassing a portion of a fluid around the element as described earlier.

Figure 5A:
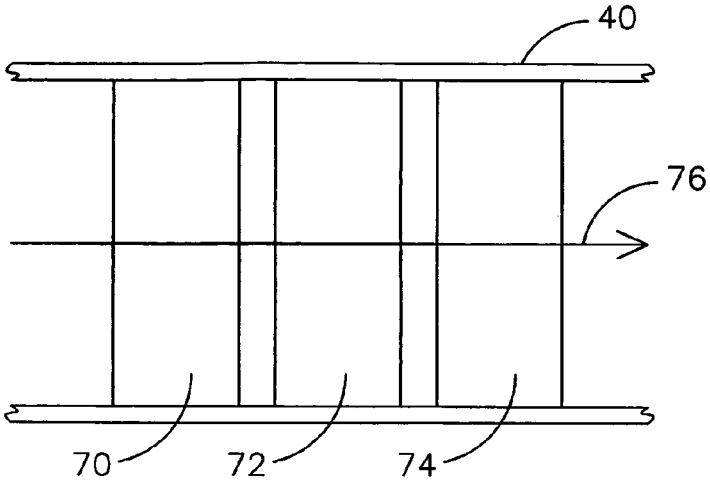
FIG. 5A shows a longitudinal cross-section of separate catalytic elements disposed within a second stage of the combustor of FIG. 1.
Figure 5B:
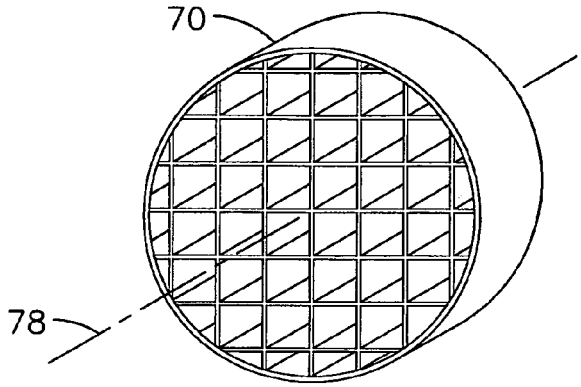
FIG. 5B shows a perspective view of an exemplary embodiment of one catalytic element of FIG. 5A.
Figure 5C:
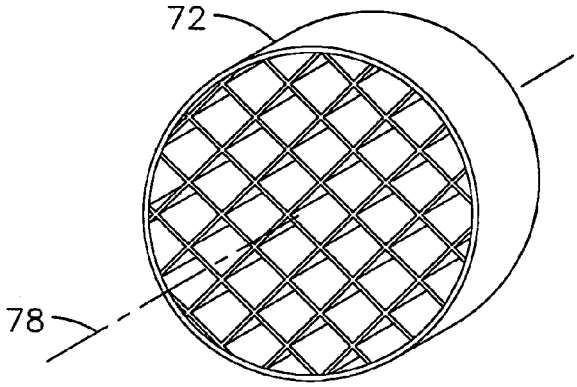
FIG. 5C shows a perspective view of another catalytic element of FIG. 5A angularly not aligned with respect to an angular orientation of the catalytic element of FIG. 5B.
Figure 5D:
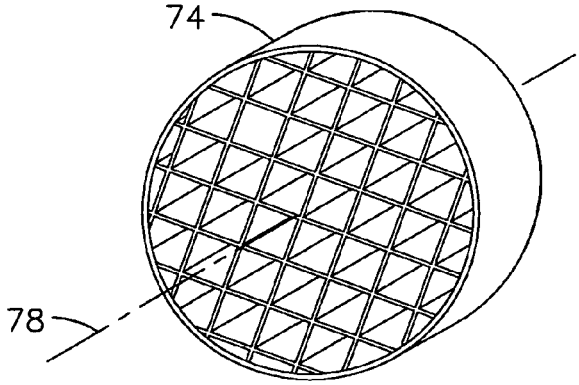
FIG. 5D shows a perspective view of another catalytic element of FIG. 5A angularly not aligned with respect to an angular orientation of the catalytic element of FIG. 5C.

In another embodiment, a catalytic structure disposed in the second catalytic stage 40 may include a number of separate catalytic elements spaced along a longitudinal axis of the second catalytic stage 40, wherein each element includes partitioned longitudinal passageways that may be coated with a catalyst. Each catalytic element may be spaced apart along the longitudinal axis with respect to an adjacent catalytic element. The catalytic supports may be different types of supports, such as tubes, plates, or honeycombs, and may have different cross sections. FIG. 5A shows a longitudinal cross-section of exemplary catalytic elements 70, 72, 74 disposed within the second catalytic stage 40 and exposed to a fluid 76, such as a partially oxidized fuel/oxidizer mixture, flowing through the second catalytic stage 40. Each element 70, 72, 74 may include a "honeycomb" arrangement of catalyst coated plates partitioning the element into longitudinal passageways. Specific Surface, Inc. and CeraMem Corporation, market such honeycomb-type elements. As shown in FIGS. 5B, 5C, and 5D, each respective element 70, 72, 74 may be angularly not aligned about a longitudinal axis 78 with respect to an adjacent catalytic element. Such misalignment, or axial rotation of the elements with respect to each other so that the passageways are not aligned, causes mixing of the fluid 76 about the longitudinal axis as the flow travels from one element to an adjacent downstream element. In another aspect, the passageways may twisted so that they do not run parallel with axis 78, thereby directing a flow of fluid through the passageway angularly away from parallel with respect to the axis 78. Advantageously, mixing of the fluid traveling through the catalytic elements 70, 72, 74, may be promoted to achieve improved catalytic combustion. As a result, an overall length of the catalytic structure may be shorter compared to a catalytic structure having aligned flowpaths extended therethrough. Each catalytic element 70, 72, 74 may be configured to have a desired characteristic, such as a catalyst composition, a flow path cross-section size, or an axial length different from another element. For example, each element 70, 72, 74 may include a catalyst selected to promote further oxidation of a fuel/oxidizer mixture flowing therethrough based on reaction products generated by an adjacent upstream element 70, 72. Alternately, a flow mixing element may be disposed between adjacent catalytic elements.

Unlike a backside cooled configuration typically used in a single-stage RCL™ catalytic combustor wherein only some of the flow paths may be coated with a catalyst material, a second-stage catalytic structure as described herein may be provided with a coating of a catalyst on all of the flow path surfaces to foster complete catalytic combustion. For example, the second-stage catalytic structure may include a number of tubes disposed in the second catalytic stage 40, each of the tubes coated with a catalyst on an outside surface and an inside surface. In an embodiment, the tubes may be hollow cylinders formed from an oxide or non oxide ceramic material (such as the ceramic materials described earlier) and include an enhanced surface area coating, such as a washcoat, applied to an inside diameter and outside diameter. A catalyst such as a perovskite, zeolite, and/or hexaaluminate, and the like, may be incorporated in the washcoat or subsequently applied over the washcoat. In another embodiment, the tubes may be formed from an advanced metal or inter-metallic. A catalytic material, such as a perovskite, zeolite, hexaaluminate, and the like, may be subsequently applied to the tubes. In another aspect, the tubes may be coated with a TBC for additional thermal protection before applying the catalytic material. In yet another embodiment the catalytic structure may comprise a number of catalyst coated rods or plates longitudinally disposed within the combustor. Such rods or plates may be formed from the materials and coated with the catalytic compositions as described above with respect to the catalytic tubes.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A catalytic combustor comprising:

a first catalytic stage comprising a metallic catalyst support and receiving an oxidizer and a fuel and discharging a partially oxidized fuel/oxidizer mixture;

a second catalytic stage comprising a ceramic reticulated foam catalyst support disposed within a pressure boundary defining a pressure boundary cross-sectional flow area, the foam catalyst support receiving a first portion of the mixture and presenting a support cross-sectional flow area less than the pressure boundary cross-sectional flow area to define a bypass passageway for allowing a second portion of the mixture to bypass the foam catalytic support, the second catalytic stage having an outlet temperature elevated sufficiently to completely oxidize the mixture without using a separate ignition source;

an oxidation completion stage disposed downstream of the second catalytic stage for recombining the first and second portions of the mixture and completing oxidation of the mixture, and a transition stage disposed between the first catalytic stage and the second catalytic stage, the transition stage comprising a narrowed flow area region disposed between an inlet end receiving the partially oxidized fuel/oxidizer mixture from the first catalytic stage and an outlet end discharging the partially oxidized fuel/oxidizer mixture into the second catalytic stage, wherein the narrowed flow area region of the transition stage has a narrower flow area than each of the first catalytic stage and the second catalytic stage.

2. The catalytic combustor of claim 1, wherein the second catalytic stage further comprises a catalytic material selected from the group consisting of perovskite, zeolite, and hexaaluminate.

3. The catalytic combustor of claim 1, wherein the bypass passageway is disposed around a portion of a perimeter of the ceramic reticulated foam catalytic support.

4. The catalytic combustor of claim 1, wherein the ceramic reticulated foam catalytic support comprises a cruciform cross-section.

5. The catalytic combustor of claim 1, wherein the ceramic reticulated foam support comprises a donut-shaped cross-section.

6. A catalytic combustor comprising:

an upstream pressure boundary comprising a catalytic surface disposed therein for receiving a fuel/oxidizer mixture and discharging a partially oxidized fuel/oxidizer mixture;

a downstream pressure boundary defining a pressure boundary cross-sectional flow area for receiving the partially oxidized fuel/oxidizer mixture;

a catalyst-coated reticulated foam support disposed within the downstream pressure boundary for receiving a first portion of the mixture and presenting a support cross-sectional flow area less than the downstream pressure boundary cross-sectional flow area to define a bypass passageway for allowing a second portion of the fuel/oxidizer mixture to bypass the foam support; and a plurality of additional bypass passageways for allowing the second portion of the fuel/oxidizer mixture to bypass the foam support, wherein said plurality of additional bypass passageways comprises a plurality of spaced apart, tubular passageways extending longitudinally through the foam support;

wherein the bypass passageway is disposed around a portion of an outer perimeter of the reticulated foam support; and wherein the reticulated foam support comprises a cross-section perimeter smaller than an internal perimeter of the pressure boundary, the foam support supported against the internal perimeter by spaced apart standoffs comprising the reticulated foam support.

7. The catalytic combustor of claim 6, wherein the reticulated foam support comprises a cross-section sized to bypass from 25% to 80% of the mixture past the foam support.

8. The catalytic combustor of claim 6, wherein the reticulated foam support defines a plurality of separate passageways within the pressure boundary.

9. The catalytic combustor of claim 6 wherein the reticulated foam support comprises a cruciform cross-section.

10. The catalytic combustor of claim 6 wherein the reticulated foam support comprises a donut-shaped cross-section.

11. The catalytic combustor of claim 6 wherein the reticulated foam support comprises a ceramic material.

12. The catalytic combustor of claim 1, wherein the narrowed flow region is configured for generating a venturi effective to protect the first catalytic stage from heat generated in the second catalytic stage.

13. The catalytic combustor of claim 1, wherein the transition stage is configured to substantially limit combustion of the partially oxidized fuel/oxidizer mixture from the first catalytic stage.

14. The catalytic combustor of claim 6, further comprising a transition pressure boundary disposed between the upstream pressure boundary and the downstream pressure boundary, the transition pressure boundary comprising a narrowed flow area region effective to generate a venturi effect disposed between an inlet end receiving the oxidized fuel/oxidizer mixture from the upstream pressure boundary and an outlet end discharging the partially oxidized fuel/oxidizer mixture into the downstream pressure boundary, wherein the transition pressure boundary is configured to substantially limit combustion of the partially oxidized fuel/oxidizer mixture from the upstream pressure boundary.

* * * * *